US006616063B2

(12) United States Patent
Boecking

(10) Patent No.: US 6,616,063 B2
(45) Date of Patent: Sep. 9, 2003

(54) INJECTOR FOR INJECTING FUEL, WITH DOWNSTREAM PRESSURE CONTROL ELEMENT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/900,966

(22) Filed: Jul. 10, 2001

(65) Prior Publication Data

US 2002/0020759 A1 Feb. 21, 2002

(30) Foreign Application Priority Data

Jul. 10, 2000 (DE) ..... 100 33 429
Mar. 7, 2001 (DE) ..... 101 10 845

(51) Int. Cl.[7] ..... F02M 41/16
(52) U.S. Cl. ..... 239/96; 137/625.64
(58) Field of Search ..... 137/625.64; 239/96

(56) References Cited

U.S. PATENT DOCUMENTS 6,484,697 B2 * 11/2002 Boecking ..... 239/96
6,488,013 B2 * 12/2002 Boecking ..... 239/96
2002/0020394 A1 * 2/2002 Boecking ..... 239/96
2002/0020759 A1 * 2/2002 Boecking ..... 239/96
2002/0050532 A1 * 5/2002 Boecking ..... 239/96

* cited by examiner

*Primary Examiner*—Gerald A. Michalsky
(74) *Attorney, Agent, or Firm*—Ronald E. Greigg

(57) ABSTRACT

Disclosed in an injector for injecting fuel into the combustion chambers of an internal combustion engine, in which control part body is received movably in an injector housing and its opening and closing motion is effected via pressure relief of a control chamber. The pressure relief of the control chamber is controlled via an externally actuatable actuator. On the control part body, a sealing seat diameter that seals off the valve chamber is provided, which closes and opens the inlet from a common rail. An annular throttle element of variable cross section is located downstream of the sealing seat diameter of the control part body. An annular throttle element of variable cross section, or a throttle slide with a throttle, is located downstream of the sealing seat diameter of the control part body.

13 Claims, 4 Drawing Sheets

INJECTOR FOR INJECTING FUEL, WITH DOWNSTREAM PRESSURE CONTROL ELEMENT

BACKGROUND OF THE INVENTION

1. Field of the Invention

The invention relates to an injector for injecting fuel into the combustion chambers of internal combustion engines. Injection systems for direct-injection internal combustion engines must now meet ever-increasing demands. For instance, it is demanded that the injection pressure and injection quantity be capable of being defined independently of one another for every operating point of the engine, so that there is one additional degree of freedom for mixture formation. At the onset of injection, the injection quantity should be as slight as possible, for the sake of the ignition delay that ensues between the onset of injection and the onset of combustion. These demands are currently met in reservoir-type injection systems (common rails) with pre-injection and main injection phases.

2. Description of the Prior Art

German Patent Disclosure DE 198 35 494 A1 relates to a unit fuel injector. It serves to deliver fuel to the combustion chamber of direct-injection internal combustion engines. A pump unit is furnished for building up an injection pressure and injecting the fuel into the combustion chamber via an injection nozzle. This is embodied with a control unit together with a control valve that is embodied as an outward-opening A-valve and with a valve actuation unit. With the valve actuation unit, the pressure buildup in the pump unit is controlled. To create a unit fuel injector with a control unit that is simple in structure, small in size, and in particular has a short response time, the valve actuation unit is embodied as a piezoelectric actuator.

From German Patent DE 37 28 817 C2, a fuel injection pump for an internal combustion engine is known. The fuel injection pump includes a control valve member comprising a valve shaft that forms a guide sleeve and slides in a conduit and a valve head connected to the valve shaft and oriented toward the actuating device. The sealing face of the valve head is embodied to cooperate with the face of the control bore that forms the valve seat. The valve shaft, on its circumference, has a recess whose axial length extends from the orifice of the fuel supply line to the beginning of the sealing face on the valve head but cooperates with the valve seat. A face exposed to the pressure of the fuel supply line is embodied in the recess that is equal in size to a face of the valve head exposed, in the closed state of the control valve, to the pressure of the fuel supply line. The result, in the closed state of the valve, is a state of pressure equilibrium. The guide sleeve receives a spring that urges the control valve toward its open position.

OBJECT AND SUMMARY OF THE INVENTION

In injection systems used previously the triangular stroke course desired often proves to be quite bulky, since when the control valve is opened the valve springs open, but with the version proposed by the invention for a control part in an injector for injecting fuel, the ensuing course of injection pressure can be better adapted to the combustion.

By connecting a flat element embodied as an annular throttle downstream, the appropriate flow quantity upon opening of the control part can be specified with extreme precision. If the annular throttle includes a conical face and a cylindrical part, then by way of specifying the cone angle at the truncated cone and the length of the shoulder on the control part embodied as a truncated cone, an adjustment of the pressure course can be done by way of the stroke of the control part.

The cylindrical portion of the annular throttle element is quite simple to manufacture technically on a rotationally symmetrical component. The cylindrical part of the annular gap throttle can be minimized except for a control edge, whose underside is adjoined—in the downstream direction—by the truncated cone of the annular throttle. Minimizing the cylindrical portion of the annular throttle element to a control edge would lead to further shortening and thus economy in terms of structural length of the injector and injector housing. The vertical up and down motion for opening and closing the valve chamber is impressed on the injector by way of a separately actuatable valve control unit, by whose opening a control chamber acting on the control part is pressure-relieved.

With the embodiment proposed by the invention of the throttle element with a truncated cone, the pressure course during injection can be adapted to the course of combustion. The injection onset, injection course, and atomization of the fuel affect the fuel consumption of an internal combustion engine and hence pollutant emissions considerably. A late injection reduces the $NO_x$ emissions as a consequence of low process temperatures. An overly late injection increases the HC emissions and fuel consumption, as well as the expulsion of soot at higher loads. A deviation of the injection onset from the desired value by only one degree of crankshaft angle can increase the $NO_x$ emissions by up to 5%. An injection onset that is too early by 2° of crankshaft angle can lead to an increase in the peak cylinder pressure of 10 bar, while a shift toward "late" by 2° of crankshaft angle can increase the exhaust gas temperature by 20° C. This high sensitivity demands a precisely set injection onset and requires that the previously calculated course of injection be adhered to. The course of injection is defined by the fuel quantity, which varies during an injection cycle (that is, from the onset to the end of an injection). The injection course determines the fuel mass pumped during the ignition delay (between the onset of injection and the onset of combustion). Furthermore, it also affects the distribution of the fuel in the combustion chamber and thus the utilization of the air. The injection course must rise slowly so that only little fuel will be injected in the ignition delay. At the onset of combustion, this fuel burns forcefully (premixed combustion), which has an unfavorable effect on noise and $NO_x$ emissions. At the end, the course of injection must drop off sharply, to prevent poorly atomized fuel in the final phase from leading to high hydrocarbon and soot emissions and increased fuel consumption.

With the injector proposed according to the invention, with an annular throttle element downstream of the seat diameter of the control part, the fuel flow rate through the nozzle can be adapted more precisely to the fuel flow rate specified by the course of combustion, for the sake of achieving the most homogeneous possible combustion.

BRIEF DESCRIPTION OF THE DRAWINGS

The invention will be better understood and further objects and advantages thereof will become more apparent from the ensuing detailed description, taken in conjunction with the drawing, in which.

DESCRIPTION OF THE PREFERRED EMBODIMENTS

Figure 1:
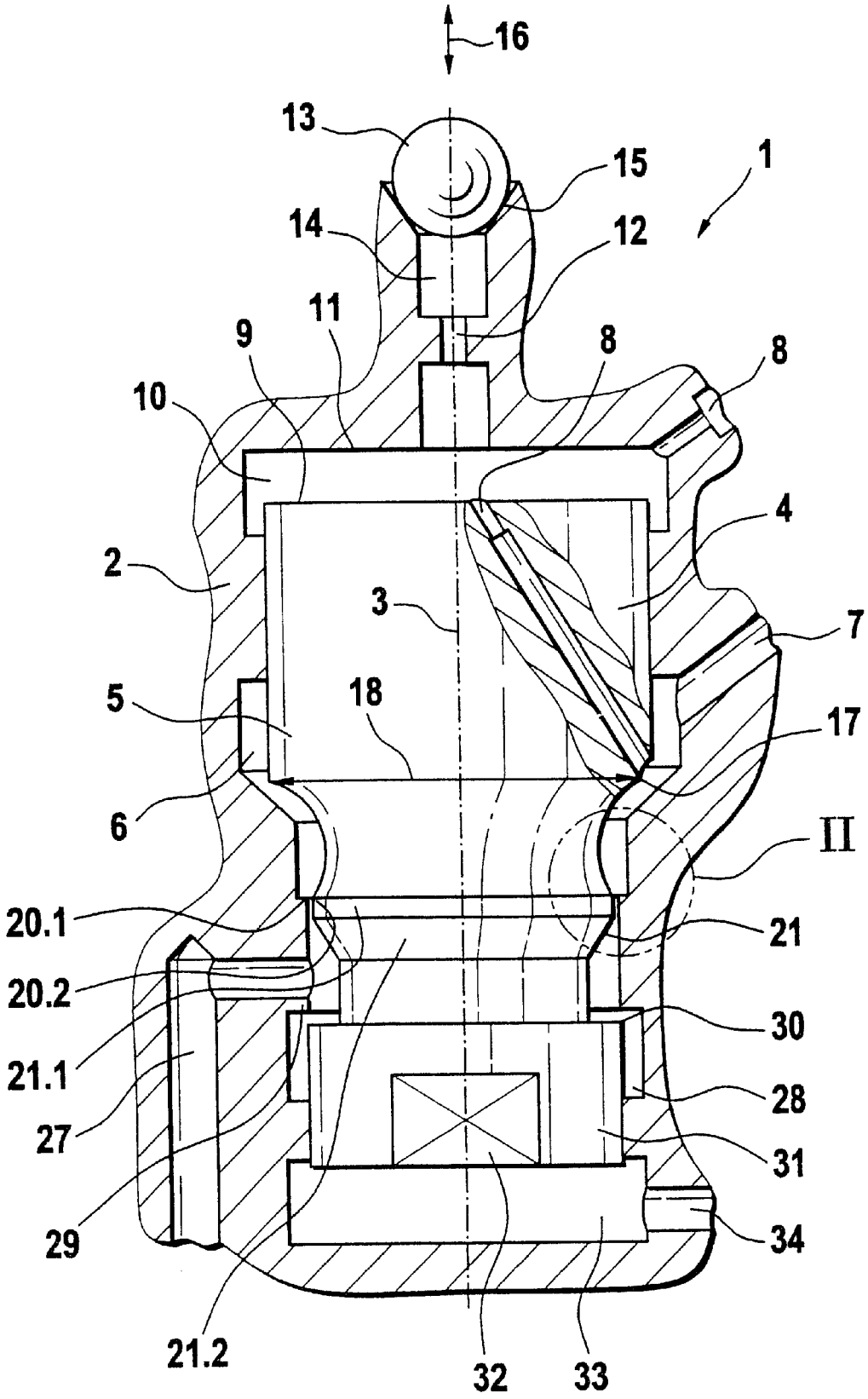
FIG. 1 is a longitudinal section through the injector together with the annular throttle element as proposed by the invention.

FIG. 1 shows a longitudinal view through an injector with an annular throttle element, proposed according to the invention, in detail.

The injector 1 substantially comprises a control part body 4 that is movable up and down in an injector housing 2. The control part body 4 is embodied as a rotationally symmetrical component and is symmetrical to its line of symmetry 3. A valve chamber 6 extending annularly is embodied surrounding the head region 5 of the control part body 4 in the injector housing 2. An inlet 7 discharges into the valve chamber 6 in the injector housing 2 from the high-pressure collection chamber (common rail). Branching off from the valve chamber 6 and acted upon by fuel at high pressure by way of it is an inlet throttle 8, which discharges into a control chamber 10 embodied in the injector housing 2. The control chamber 10 is defined on one side by the upper end face 9 of the head region of the control part body 4 and on the other is surrounded by a control chamber boundary wall 11 embodied in the injector housing 2.

The control volume entering the control chamber 10 continuously from the inlet 7 of the common rail via the inlet throttle 8 can be pressure-relieved via an outlet throttle 12 upon opening of a closing element 13. To that end, by means of an actuator, not shown in detail, the closing element is actuated in the vertical direction (double-headed arrow 16). The actuator, not shown in detail, can be a piezoelectric actuator, an electromagnet, or a hydraulic-mechanical actuator. Upon pressure relief of the control chamber 10 via the outlet throttle 12, the closing element—here embodied as a ball-shaped closing element—is moved out of its sealing seat 15. As a result, a hollow chamber 14 that communicates on the outlet side with the outlet throttle 12 is opened, so that the control volume enclosed in the control chamber 10 can flow out via the outlet throttle 12. A pressure relief in the control chamber 10 ensues, which causes a vertical upward motion of the control part 4.

A seat diameter 18 is embodied in the lower region of the head region 5 of the control part body 4. The seat diameter 18 forms a sealing seat 17, by way of which, upon coarse action on the control chamber 10 via the inlet throttle 8 which can also discharge directly into the control chamber 10, the valve chamber 6 is sealed off from the nozzle inlet 27. A constriction 19 extends along the control part body 4 below the sealing seat diameter 18. The constriction 19 terminates in a control edge 20.1 of the control part body 4. Adjoining this on the control part body 4 is an annular throttle element 21, which in the view of FIG. 1 has a portion 21.1 with a cylindrical surface and an adjoining frustoconical throttle region 21.2, these portions being shown on a larger scale and in more detail in FIG. 2.

The nozzle inlet 27 is embodied in the injector housing 2 below the annular throttle element 21. Below the nozzle inlet 27 in the injector housing 2 of the injector 1, there is an annularly extending leaking oil chamber 28. Its upper boundary is formed by the leaking oil control edge 29 in the housing 2, which cooperates with a control edge 30 embodied on the leaking oil slide 31. Outflow faces 32 are provided on the leaking oil slide 31, by way of which faces the fuel, flowing out upon pressure relief of the nozzle, can enter the leaking oil chamber 33 located below the leaking oil slide 31 and from there can enter the leaking oil outlet 34.

Figure 2:
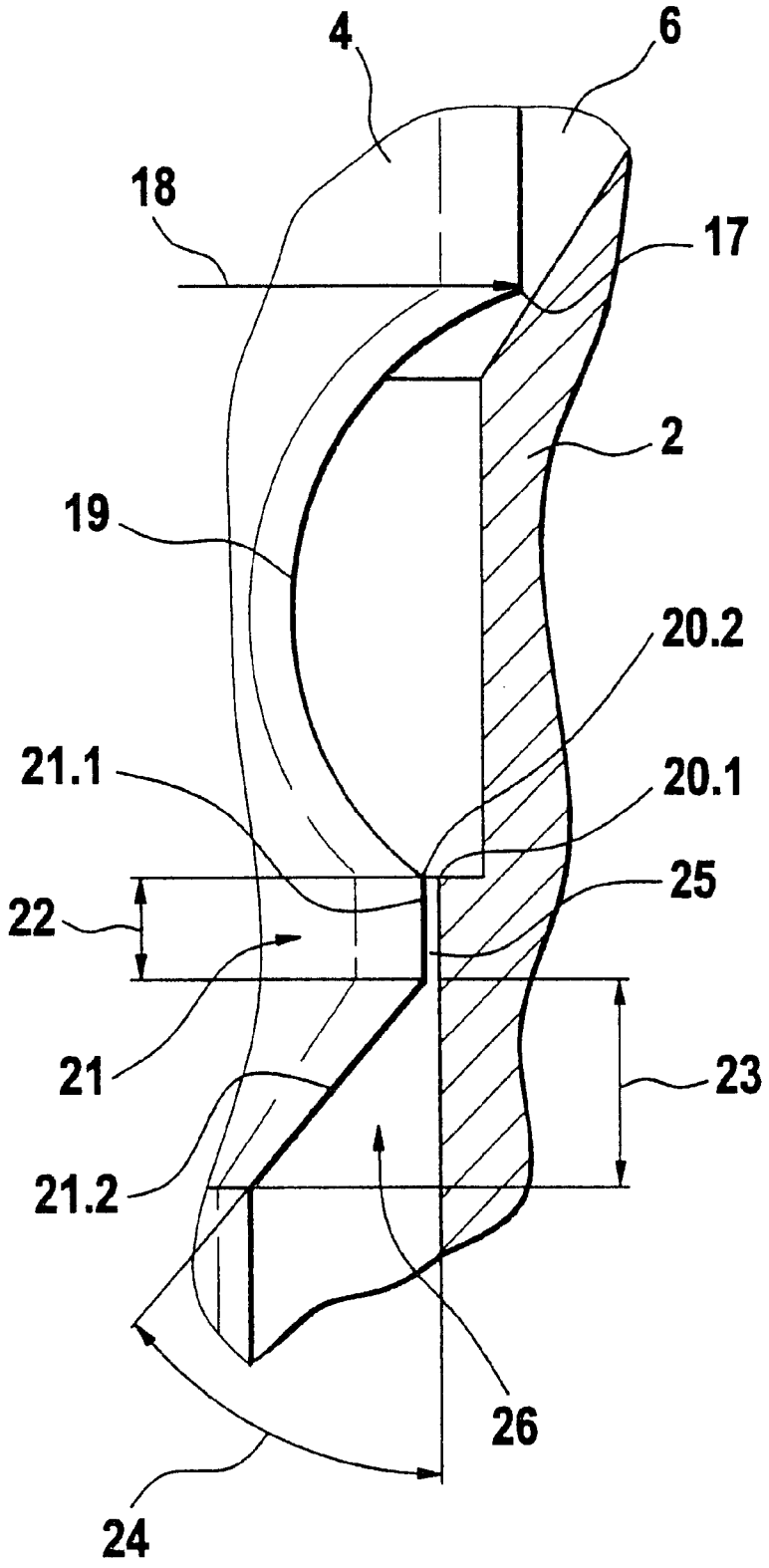
FIG. 2 is an enlarged view of the annular throttle element, comprising an annular gap face with a truncated cone extending downstream.

The geometry of the constriction 19 below the sealing seat on the control part body 4 and the geometry of the annular throttle element are seen in greater detail and on a larger scale in the view of FIG. 2.

As already described in detail in conjunction with FIG. 1, the valve chamber 6 inside the injector housing 2 is closed at its sealing seat 17 by the control part body 4 upon imposition of pressure on the control chamber 10. At the sealing seat 17, the control part body 4 has the seat diameter 18 in the lower region of the head region 5. The seat diameter is adjoined by the constriction 19, which in turn terminates in the control edge 20.2. Opposite the control edge 20.2, a control edge 20.1 is embodied toward the housing, and between these edges an annular gap 25 is formed. In the view of FIG. 2, the annular throttle element 21 includes a cylindrical region 21.1, which in the axial direction has the stroke height $h^1$ (reference numeral 22). This region is adjoined downstream by a frustoconical region of the throttle element 21. The jacket face of the truncated cone is embodied at an angle $\alpha$ (24) to the bore in the injector housing 2. The angle $\alpha$ can range between 30° and 60° and thereby defines an opening course 26 at the region toward the truncated cone of the throttle element, and this region enables a variable throughput of the fuel flow rate into the nozzle inlet 27 (see the view in FIG. 1). The frustoconically extending region 21.2 of the throttle element 21 has a truncated cone length 23, viewed in the axial direction. The annular throttle element 21 shown in detail in FIG. 2 extends axially over the length 22 and 23. Instead of two throttle regions comprising a cylindrically extending throttle face 21.1 and a frustoconical throttle region 21.2, the cylindrical annular throttle region 21.1 could also, in a variant embodiment, be limited solely to the control edge 20.2, so that with respect to the axial length of the control part body 4, the stroke height 22 could be dispensed with. Then the annular gap 25 would be reduced to an annularly extending opening and would discharge directly into the region 26 of variable cross section of the frustoconically configured throttle region 21.2.

The mode of operation of the injector proposed by the invention is as follows:

When the control chamber 10 is opened by actuation of what here is a ball-shaped closing element 13 out of its sealing seat 15, the control chamber 10 is pressure-relieved; that is, the control volume flows out via the outlet throttle 12 and enables a vertical upward motion of the head region 5 of the control part body 4. As a result, the valve chamber 6 is opened; fuel at high pressure flows from the inlet 7, which in turn communicates with the high-pressure collection chamber (common rail), into the region of the bore in the injector housing 2 into which the nozzle inlet 27 discharges. As a result, the nozzle inlet is subjected to fuel at high pressure, which is then present at the injection nozzle. At the same time, the control edges 30 and 29 move past one another at the leaking oil slide 31 and thus seal off the inlet 7 of the common rail from the leaking oil chamber 33.

In the upward motion vertically of the control part body 4 into control chamber 10, the annular throttle element 21 brings about a controlled inflow of the fuel that is at high pressure into the nozzle inlet 27, since the annular gap 25 acts as a throttle, and the fuel flow rate can be injected into the combustion chamber of a direct-injection internal combustion engine in accordance with the ignition delay occurring in combustion as a function of the course of combustion. While the flame front initially develops slowly in the combustion chamber, the fuel flow rate entering via the annular gap 25 is limited. This flow rate does not increase until the control part body 4 of the injector 1, upon further pressure relief of the control chamber 10, moves farther upward, and the fuel, via the variable cross section 26 adjoining the annular gap, enters the nozzle inlet 27 at a higher flow rate. As a result, as the flame front spreads, the combustion chamber is supplied with a greater fuel flow rate, so that a fuel quantity suitable for the course of combustion is made available for combustion.

If the actuator 16 is actuated in the effective actuator direction, the ball-shaped closing element 13 is pressed into its seat 15. By means of the fuel flowing continuously into the control chamber 10 via the inlet 7 from the common rail via the inlet throttle 8, a control volume 10 builds up there, and the pressure rises. As a result, the end face 9 of the head region 5 of the control part body 4 moves downward. Accordingly, the seat diameter 18 moves into its sealing seat 17, so that the valve chamber 6 is sealed off. At the same time, the control edges 29 and 30 have moved out of their overlap at the leaking oil slide 31 and relieve the nozzle inlet 27. Outflowing fuel flows via the annular chamber 28 and the outflow faces 32 into the leaking oil chamber 33 and from there back into the fuel tank of the motor vehicle via the leaking oil outlet 34.

Figure 3:
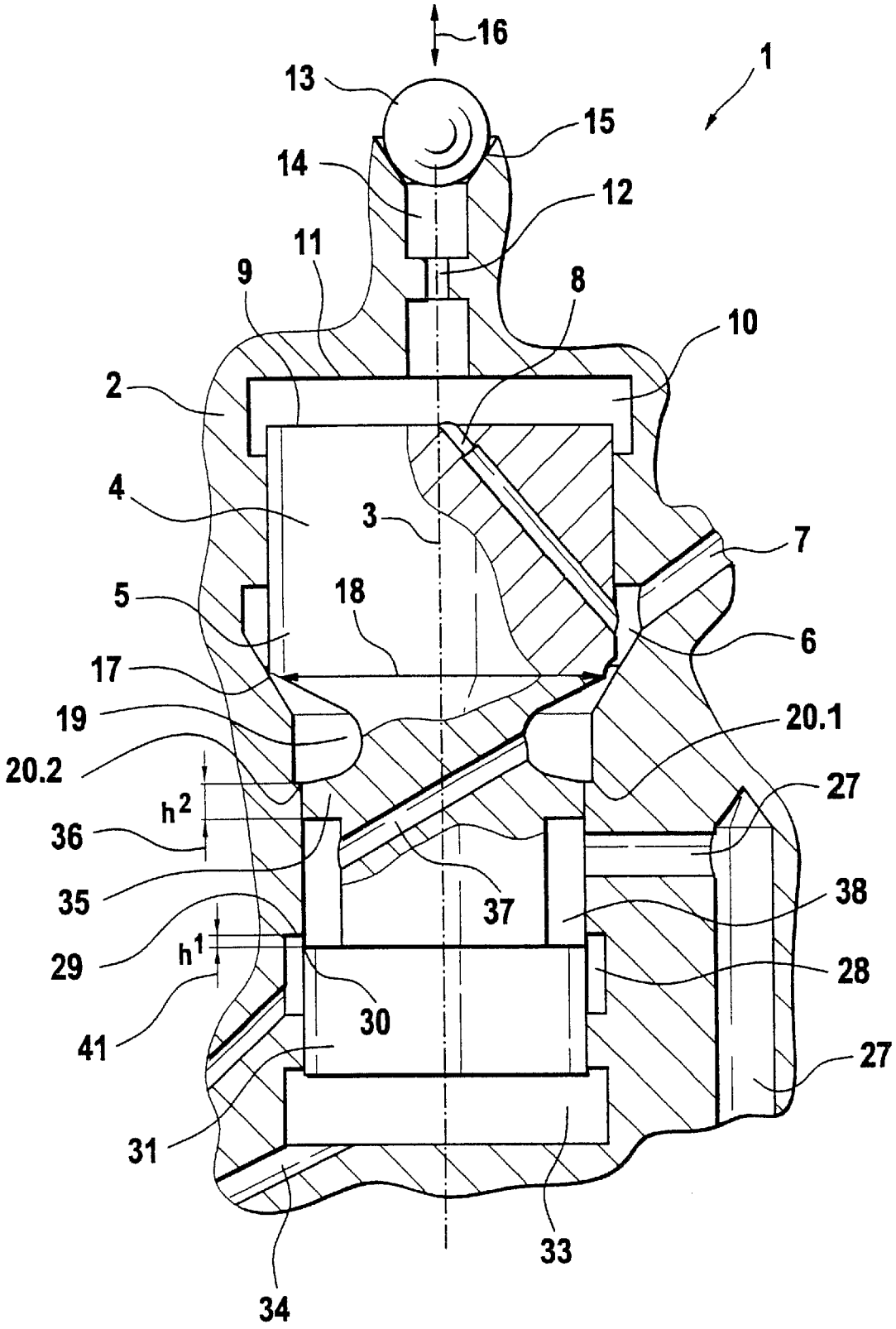
FIG. 3 is a cross section through an alternative variant embodiment of a control part body with a slide portion that is pierced by a throttle bore.

FIG. 3 shows a cross section through an alternative embodiment, in which the control part body is provided with a slide portion, and this slide portion is pierced by a throttle bore.

In this variant embodiment of a control part body 4 of an injector 1 for injecting fuel, the throttle function is achieved by a throttle slide 35 and a bore 37 piercing this throttle slide in the control part body 4.

The injector 1 in the view of FIG. 3 includes a control part body 4, which is received displaceably in an injector housing 2 and whose vertical motion in the injector housing 2 is attained by means of a pressure relief of the control chamber 10. An outlet throttle 12 is associated with the control chamber 10 and can be closed or opened via a ball-shaped closing element 13 that is actuatable via a piezoelectric or other suitable actuator. By means of the actuator, the ball-shaped closing element 13 is pressed into its closing seat 15 above a hollow chamber 14. The outlet throttle 12 discharges into a control chamber boundary wall 11 provided on the injector housing 2. Via an inlet throttle 8 provided in the head region 5 of the control body 4, the control chamber 10 is acted upon continuously by fuel via the inlet 7 from the high-pressure collection chamber (common rail). The conduit associated with the inlet throttle 8 discharges into the valve chamber 6, which annularly surrounds the head region 5 of the control part body 4. Toward the control chamber, the inlet throttle 8 discharges from the end face 9 of the head region 5 of the control part body 4.

In the state shown in FIG. 3, the control chamber 10 of the injector 1 is acted upon by a fuel volume; the outlet throttle 12 is closed by the closing element 13. By means of the fuel volume, which is under pressure, contained in the control chamber 10, the end face 9 is pressed by means of the head region 5 of the control part body 4 into its sealing seat 17 in the injector housing 2. The seat diameter 18 of the control part body 4 rests in the sealing seat 17 and closes the valve chamber 6 and thus the inlet 7 from the common rail.

The control part body 4 is adjoined at the seat diameter 18 by a constriction 19, which at the control part body 4 merges with a throttle slide 35. The throttle slide 35 is provided with a throttle slide overlap 36 ($h^2$). The throttle slide 35 is pierced by a throttle bore 37 at the control part body 4. Via the throttle bore 37, an annular chamber 38, which toward the housing surrounds the control part body 4, and a hollow chamber formed between the constriction 19 and the injector housing 2 communicate with one another; upon pressure relief of the control chamber 10, the hollow chamber is in communication with the fuel at high pressure that is shooting in upon pressure relief of the control chamber 10.

Branching off from the annular chamber 38 adjoining the throttle slide 35 is a nozzle inlet 27 toward the nozzle chamber in the injector 1, which surrounds a nozzle needle with a pressure shoulder, not shown here.

Also embodied on the control part body 4 in the variant embodiment of FIG. 3 is a leaking oil slide 31, which opens or closes a leaking oil chamber 28, provided in the injector housing 2, with its leaking oil control edge 30 relative to the leaking oil control edge 29 provided on the housing. The fuel supply line stroke 41 ($h^1$) is dimensioned to be shorter than the throttle slide overlap 36 ($h^2$). A leaking oil chamber 33 is provided below the leaking oil slide 31 and communicates with a leaking oil outlet 34, by way of which the leaking oil at the injector can flow back into a fuel reservoir.

Figure 4:
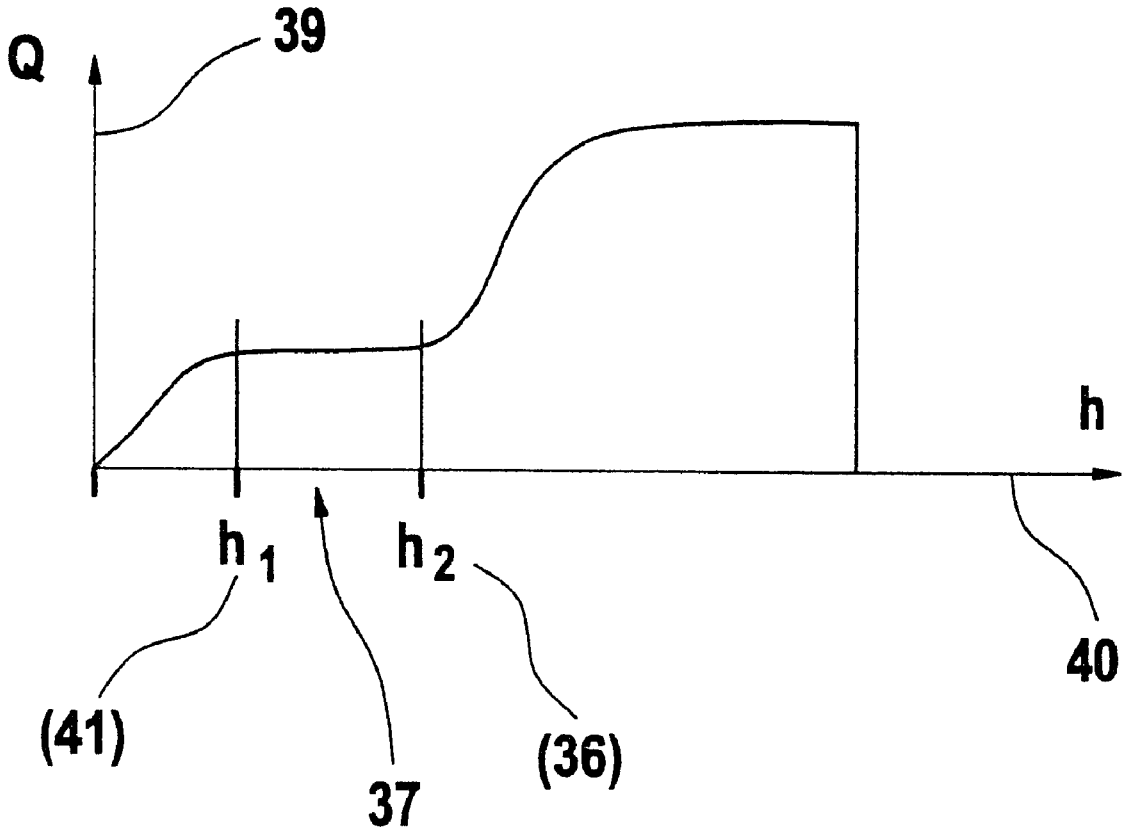
FIG. 4 is a flow chart showing the fuel quantity throughput over the control part stroke path.

FIG. 4 shows a flow chart which illustrates the throughput fuel quantity over the stroke path of the control part.

From this chart it can be seen that because of the different overlap 36 and 41 of the leaking oil slide 31 and the throttle slide 35, respectively, a booting phase can be generated during a fuel injection by way of the throttle bore 37 piercing the control part body 4. Upon pressure relief of the control chamber 10 by triggering of the actuator that acts on the closing element 13, the end face 9 of the control part body 4 moves into the control chamber 10. Fuel at high pressure shoots into the valve chamber 6 from the inlet 7 from the high-pressure collection chamber (common rail), along the opened seat 17 and 18, and from there through the throttle bore 37, discharging at the constriction 19, into the annular chamber 38 that is located downstream of the throttle slide 35 on the control part body. The overlap 36 of the throttle slide 35 assures that fuel will shoot only through the throttle bore 37 into the annular chamber 38, surrounding the control part body 4; from this chamber 38 the nozzle inlet 27 branches off in the nozzle chamber of an injection nozzle. At this instant, the leaking oil slide 31 has moved upward in accordance with its overlap 41 ($h^1$) in such a way that the leaking oil chamber 28 closes the annular chamber 38 on the side toward the leaking oil. During the inflow of the fuel that is at high pressure into the annular chamber 38 via the throttle bore 37 and thus into the nozzle inlet 27, the pressure remains virtually constant, until a further pressure relief of the control chamber 10 has brought about a further upward motion of the head region 5 of the control part body 4, with its end face 9 into the control chamber 10, which upward motion exceeds the throttle slide overlap 36 ($h^2$). Thus the flow cross section available for the inflow of the fuel that is at high pressure is opened completely in the bore in the injector housing 2, so that a greater quantity of fuel that is at high pressure can shoot into the nozzle inlet 27 via the annular chamber 38. On the leaking oil side, the leaking oil chamber 28 is closed by the overlap of the control edge 29 of the housing with the control edge 30 of the leaking oil slide 31.

With the provision as shown in FIG. 3 and proposed according to the invention, a booting phase during the injection phase can be brought about, which has advantages in particular with regard to exhaust gas production and noise emissions in combustion in direct-injection internal combustion engines. The precision and duration of the booting phase can be adjusted by way of the precision of manufacture of the throttle bore 37, and in particular the resultant slide play between the throttle slide 35 and the bore in the injector housing 2 is of significance.

The foregoing relates to preferred exemplary embodiments of the invention, it being understood that other variants and embodiments thereof are possible within the spirit and scope of the invention, the latter being defined by the appended claims.

I claim:

1. An injector for injecting fuel into the combustion chambers of an internal combustion engine, comprising a control part body (4) which is movable in an injector housing (2) and whose opening and closing motion is effected via pressure relief of a control chamber (10) that is controlled by an externally actuatable actuator (16), a sealing seat diameter (18) that seals off a valve chamber (6) is embodied on the control part body (4) and closes or opens the inlet (7) from a common rail, and an annular throttle element (21) of variable cross section (25, 26) or a throttle slide (35) with a throttle (37) disposed downstream of the sealing seat diameter (18) on the control part body (4).

2. The injector according to claim 1, wherein the annular throttle element (21) comprises throttle portions (21.1, 21.2) connected in cascade form one after the other.

3. The injector according to claim 1, wherein the first throttle portion (21.1) includes a control edge (20.2), which with the injector housing (2) defines an annular gap (25).

4. The injector according to claim 3, wherein the first throttle portion (21.1) extends cylindrically over a length (22) on the control part body (4).

5. The injector according to claim 1, wherein the throttle element (21) includes a conically configured portion (21.2).

6. The injector according to claim 5, wherein the cone angle (24) of the conical throttle portion (21.2) is between 30° and 60°.

7. The injector according to claim 5, further comprising a cross-sectional enlargement (26) embodied between the jacket face of the frustoconical throttle portion (21.2) and the injector housing (2) over the frustoconical length (23).

8. The injector according to claim 1, further comprising a constriction (19) embodied on the control part body (4) between the sealing seat (17) of the control part body (4) in the injector housing (2) and the throttle element (21).

9. The injector according to claim 5 wherein the jacket face of the conical throttle portion (21.2) is provided with contouring for controlling the course of the injection pressure.

10. The injector according to claim 1, wherein the throttle slide (35) is embodied with an overlap (36) that exceeds an overlap (41) of a leaking oil slide (31).

11. The injector according to claim 1, wherein the throttle (37) discharges below the sealing seat (17, 18) of the control part body (4) into an annular chamber (38) communicating with the nozzle inlet (27).

12. The injector according to claim 1, wherein the throttle (37) comprises as a bore of constant cross section, piercing the control part body (4).

13. The injector according to claim 1, wherein the throttle (37) comprises as a bore of varying cross section, piercing the control part body (4).

* * * * *